US011933497B2

(12) United States Patent
Lunel et al.

(10) Patent No.: US 11,933,497 B2
(45) Date of Patent: Mar. 19, 2024

(54) FUEL INJECTION SYSTEM FOR A TURBOMACHINE, COMBUSTION CHAMBER COMPRISING SUCH A SYSTEM, AND ASSOCIATED TURBOMACHINE

(71) Applicant: SAFRAN AIRCRAFT ENGINES, Paris (FR)

(72) Inventors: Romain Nicolas Lunel, Moissy-Cramayel (FR); Haris Musaefendic, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 17/779,789

(22) PCT Filed: Nov. 24, 2020

(86) PCT No.: PCT/FR2020/052164
§ 371 (c)(1),
(2) Date: May 25, 2022

(87) PCT Pub. No.: WO2021/105607
PCT Pub. Date: Jun. 3, 2021

(65) Prior Publication Data

US 2023/0003386 A1 Jan. 5, 2023

(30) Foreign Application Priority Data

Nov. 26, 2019 (FR) ..... 1913223

(51) Int. Cl.
*F23R 3/28* (2006.01)
*F23R 3/14* (2006.01)

(52) U.S. Cl.
CPC ..... *F23R 3/286* (2013.01); *F23R 3/14* (2013.01); *F23R 3/283* (2013.01)

(58) Field of Classification Search
CPC .... F23R 3/14; F23R 3/28; F23R 3/283; F23R 3/286
See application file for complete search history.

(56) References Cited

U.S. PATENT DOCUMENTS 6,035,645 A * 3/2000 Bensaadi ..... F23R 3/14 60/742
6,314,739 B1 11/2001 Howell et al.
(Continued)

FOREIGN PATENT DOCUMENTS

EP 1 840 467 A1 10/2007
FR 3001283 A1 * 7/2014 ..... F23R 3/14
FR 3 033 030 A1 8/2016

OTHER PUBLICATIONS

French Search Report for French Application No. 1913223, dated Jun. 25, 2020.

(Continued)

*Primary Examiner* — William H Rodriguez
(74) *Attorney, Agent, or Firm* — Birch, Stewart, Kolasch & Birch, LLP

(57) ABSTRACT

The invention relates to an air/fuel injection system for a turbomachine, comprising:—an injector comprising a duct and an injection nose, arranged inside said duct, which extends from upstream to downstream along a longitudinal axis;—a mixer device comprising a bowl comprising an annular inlet, forming the inlet of the mixer device, from which there extends a conical portion flared in the downstream direction, said mixer device being arranged downstream of the injection nose; the injection system being characterized in that the injector comprises an air-injection annulus extending from the duct and from which there extends a connection ring comprising a divergent portion, said ring being arranged externally around the annular inlet of the mixer device.

11 Claims, 3 Drawing Sheets

(56) References Cited

U.S. PATENT DOCUMENTS 7,908,865 B2 * 3/2011 Cayre ..... F23R 3/14 239/404
11,242,994 B2 * 2/2022 Guezel ..... F23R 3/002
2005/0044854 A1 * 3/2005 Cazalens ..... F23R 3/286 60/740
2006/0059915 A1 * 3/2006 Furletov ..... F23R 3/30 60/740
2007/0033950 A1 * 2/2007 Bernier ..... F23R 3/14 60/740
2007/0084215 A1 * 4/2007 Hernandez ..... F23R 3/283 60/748
2007/0227147 A1 10/2007 Cayre et al.
2008/0000447 A1 * 1/2008 Locatelli ..... F23R 3/14 123/306
2008/0178597 A1 * 7/2008 Cayre ..... F23R 3/14 239/399
2011/0271682 A1 * 11/2011 Sandelis ..... F23C 7/004 60/737
2013/0283803 A1 * 10/2013 Bunel ..... F23R 3/14 60/737
2014/0090382 A1 * 4/2014 Sandelis ..... F23R 3/28 60/740
2016/0153662 A1 * 6/2016 Cayre ..... F23R 3/286 60/737
2017/0067638 A1 * 3/2017 Le Pannerer ..... F23R 3/283
2019/0376689 A1 * 12/2019 Guezel ..... F23R 3/286
2021/0199297 A1 * 7/2021 Chapelle ..... F23R 3/005

OTHER PUBLICATIONS

International Search Report for International Application No. PCT/FR2020/052164, dated Mar. 3, 2021.

* cited by examiner

FUEL INJECTION SYSTEM FOR A TURBOMACHINE, COMBUSTION CHAMBER COMPRISING SUCH A SYSTEM, AND ASSOCIATED TURBOMACHINE

GENERAL TECHNICAL FIELD

The invention relates to air and fuel injection systems equipping the annular combustion chambers of the turbomachines, in particular those of aircrafts.

STATE OF THE ART

Figure 1:
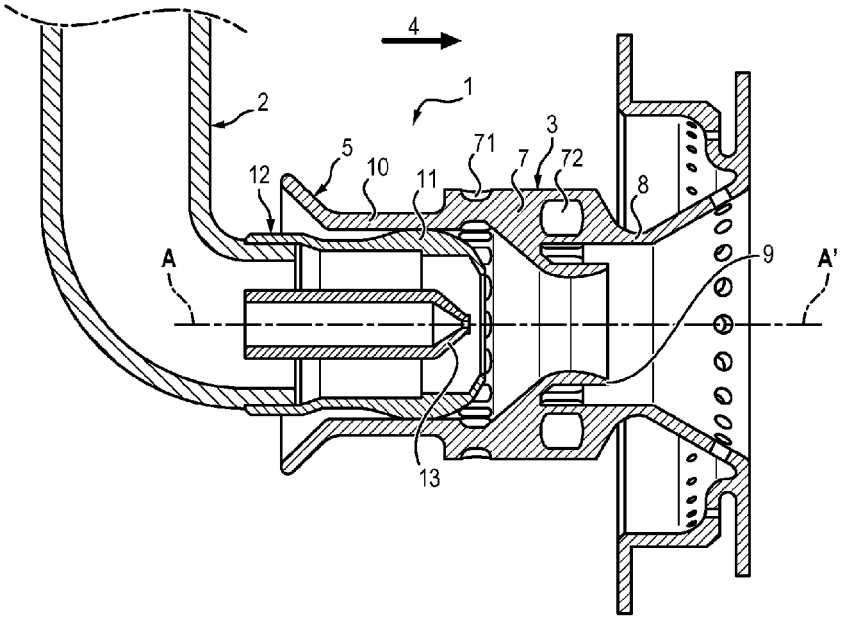
FIG. 1 PRIOR ART

FIG. 1 illustrates an air and fuel injection system 1 of a known type, comprising a fuel injector 2 and a mixing device 3 equipping a bottom wall of a combustion chamber (not represented in FIG. 1).

More specifically, the mixing device 3 comprises, from upstream to downstream along a general flow direction 4 of the fuel, a member for centering 5 a head 12 of the injector 2, an air intake ring 7 and a conical wall 8 which is flared downstream, called bowl in the following. The bowl 8 is intended to guide at the outlet of the injection system 1 a mixing of air and fuel intended to ignite in the primary area of the combustion chamber. The centering member 5 (or sliding lead-through) consists of an annular part flared upstream in order to facilitate the introduction of the injection head during its mounting. The air intake ring 7 includes fins (not represented) to impart to the air passing through this ring a gyration movement about a longitudinal axis AA' of the mixing device 3. This ring comprises a primary gimlet 71 and a secondary gimlet 72. In addition, the mixing device 3 is equipped with a venturi 9 in order to accelerate the flow of the fluids at its level.

As can be seen in FIG. 1, the head of the injector 12 comprises an injection nose 13 through which the fuel is intended to be supplied. The head 12 is inserted into the mixing device 3 via the centering member 5. Preferably, the head 12 of the injector is in contact with the inner annular wall 10 of the mixing device 3 along a spherical portion 11 which allows having a swivel connection between the inner annular wall 10 and the head 12.

Such a connection allows authorizing movements of the head 12 of the injector during the operation of the turbomachine to avoid damaging this area which could lead to breakdowns with negative consequences.

Thus, in operation, relative displacements can be observed between the injector and the mixing device 3 as well as manufacturing defects. That is to say the spherical portion 11 of the head of the injector 12 can move upstream or downstream (along the general direction 4).

However, such displacements can be problematic:

- If the head 12 of the injector is shifted downstream, then depending on the case, it is possible that the head 12 obstructs the primary 71 and secondary 72 gimlets and then be detrimental to the volume of air brought into the mixing device 3;
- If the head 12 of the injector is shifted upstream then the fuel spray derived from the head 12 can affect the venturi 9 and the bowl 8. Indeed, the role of the head 12 of the injector is to generate a mist of fine droplets, if these droplets affect the venturi 9, they will run off and be transformed into relatively larger droplets. In addition, the fuel spray angle must not be reduced by the venturi 9.

Presentation of the Invention

The invention proposes to overcome at least one of these drawbacks.

To this end, the invention proposes, according to a first aspect, an air and fuel injection system of a turbomachine comprising:

- an injector comprising a pipe and an injection nose disposed inside said pipe which extends from upstream to downstream along a longitudinal axis;
- a mixing device comprising a bowl comprising an annular inlet, forming the inlet of the mixing device, from which a conical portion flared downstream extends, said mixing device being disposed downstream of the injection nose;

the injection system being characterized in that the injector comprises an air injection ring extending from the pipe and from which a connection bushing comprising a divergent portion extends, said bushing being disposed externally around the annular inlet of the mixing device.

The invention, according to the first aspect, is advantageously completed by the following characteristics, taken alone or in any one of their technically possible combinations:

- the air injection ring is disposed downstream of the pipe;
- the inlet of the mixing device is disposed downstream of the injection nose;
- the inlet of the mixing device comprises an outer surface taking the form of a truncated sphere, the injector connection bushing being in contact with the inlet of the mixing device via said truncated sphere;
- the injector comprises a venturi located axially at the injection head;
- it comprises a first gimlet disposed upstream of the venturi and a second gimlet disposed downstream of the venturi, said first and second gimlets comprising air passages;
- the injection nose, the venturi, the air injection ring are formed in one piece, preferably obtained by an additive manufacturing process.

According to a second aspect, the invention proposes a combustion chamber of a turbomachine comprising an injection system according to the first aspect of the invention.

According to a third aspect, the invention proposes a turbomachine comprising a combustion chamber according to the second aspect of the invention.

PRESENTATION OF THE FIGURES

Figure 2:
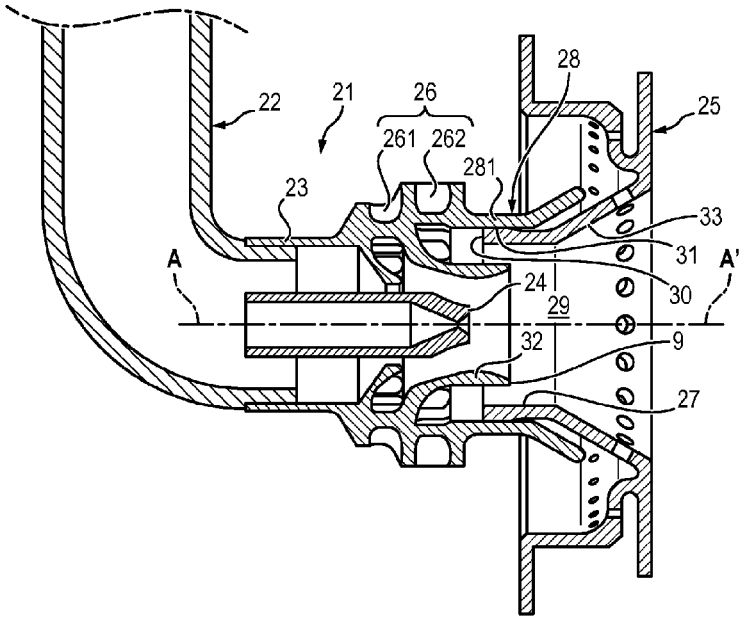
Figure 3C:
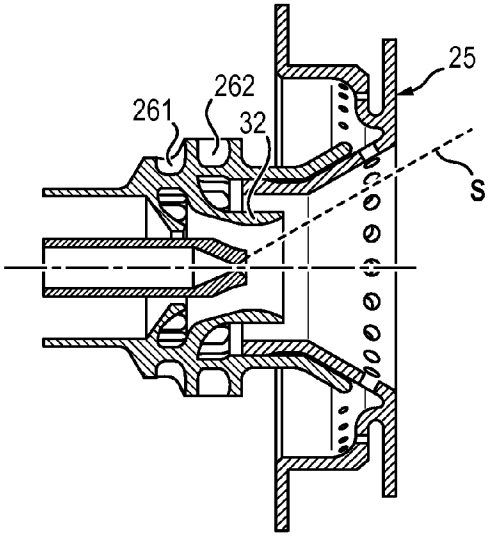
Figure 3B:
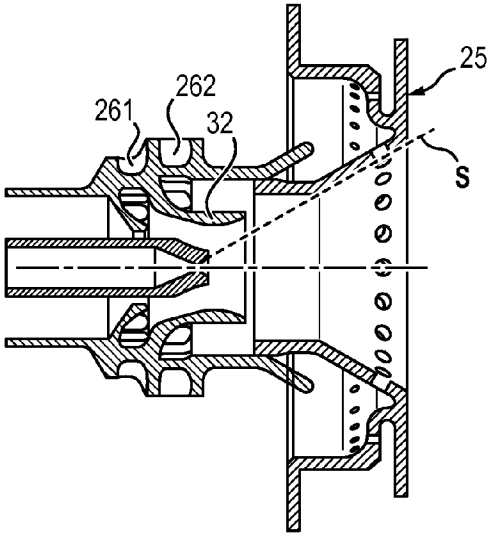
Figure 3A:
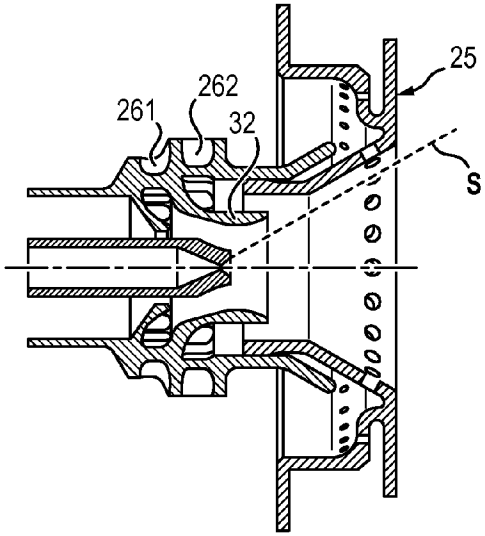
Figure 4:
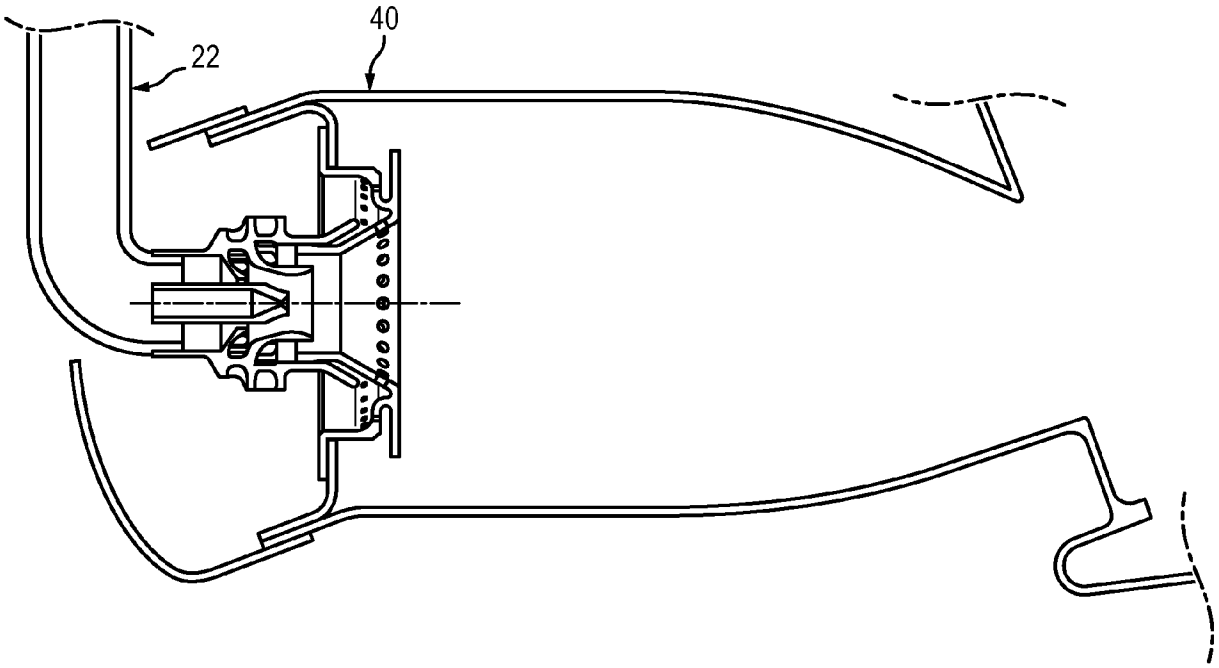

Other characteristics, aims and advantages of the invention will emerge from the following description, which is purely illustrative and not limiting, and which should be read in relation to the appended drawings in which, in addition to FIG. 1, illustrates an injection system of a known type;

FIG. 2 illustrates an injection system according to one embodiment of the invention;

FIGS. 3*a*, 3*b* and 3*c* illustrate an injection system according to the invention in operation;

FIG. 4 illustrates a combustion chamber according to the invention.

In all the figures, similar elements bear identical references.

DETAILED DESCRIPTION OF THE INVENTION

FIG. 2 illustrates an air and fuel injection system 21 of a turbomachine according to one embodiment of the invention.

Such an injection system comprises an injector 22 and a mixing device 25 disposed downstream of the injector 22 along a flow direction of the fuel in the injection system.

It is specified here that the upstream and downstream are defined in relation to the flow direction of the fuel (from left to right in FIG. 2).

The injector 22 comprises a fuel supply pipe 23 ending with an injection nose 24. This pipe 23 is in the extension of an upstream duct and bends with the latter.

The pipe 23 extends from upstream to downstream along a longitudinal axis AA' of the air and fuel injection system. The injector 22 further comprises an air injection ring 26, downstream of the pipe 23. The air injection ring 26 comprises a first gimlet 261 and a second gimlet 262. The ring 26 surrounds the injection nose 24. The first and second gimlets of the air injection ring 25 comprise air passages disposed all around.

A bushing 28 for connecting the injector 22 to the mixing device 25 extends from the air injection ring 26. This bushing 28 comprises an annular portion 281 which is extended by a divergent portion 282 flared downstream.

The mixing device 25 is disposed downstream of the injection nose 24. The mixing device 25 consists in particular of a bowl 27 comprising an annular inlet 30 which is extended by a conical portion 33 flared downstream. The annular inlet 30 constitutes the inlet of the mixing device Thus, the mixing device 25 defines an annular cavity 29 in which, in operation, the mixing of air and fuel takes place.

In addition, the injector is partly disposed in this annular cavity 29.

The injector must be in fluid communication with the mixing device.

It is through the bushing 28 of the injector that the injector 22 is in communication with the mixing device 25. The connection bushing 28 is advantageously disposed around the inlet 30 of the mixing device 25. Furthermore, the connection bushing 28 has an internal diameter greater than that of the inlet 30 of the mixing device 25 such that this connection bushing 28 encompasses the inlet of the mixing device.

In addition, as can be seen in FIG. 2, this bushing 28 is flared downstream in order to facilitate the insertion of the mixing device 25 inlet, at the bowl 27, into the connection bushing 28 during the assembly of the injector to the mixing device.

The inlet 30 of the mixing device 25 comprises an outer surface 31 which takes the form of a truncated sphere and the bushing 28 is in contact with the inlet of the bowl via this truncated sphere. The injector and the mixing device have at this contact area a connection that authorizes a relative displacement of the injector relative to the mixing device. Particularly, the injector and the mixing device have at this contact area a swivel connection. As will be understood, compared to the arrangement of the prior art as illustrated in FIG. 1, now the sphere is located on the outer surface of the inlet 30 of the mixing device 25 and the inlet 30 of the mixing device is located downstream of the injection nose 24.

As will be seen later, this arrangement allows, during the operation of the injection system, authorizing relative displacements of the injector relative to the mixing device without impact on the operation of the injection system. Indeed, as presented in the introduction during the operation of the turbomachine, the injection system is subjected to very strong movements which are applied to the different elements constituting the injection system.

Advantageously, the injector 22 comprises a venturi 32 located axially in the vicinity of the injection nose 24. Compared to the arrangement of the prior art, it is noted here that the venturi 32 forms part of the injector and not of the mixing device.

The venturi 32 is disposed between the first and second gimlets of the air injection ring 26 of the injector 22. Thus, unlike the arrangement of the prior art as illustrated in FIG. 1, the injection head is now axially disposed at the venturi 32 and is closer to the inlet 30 of the mixing device. The mixing is therefore better.

Advantageously, the duct 23, the bushing 28 and the venturi 32 are formed in one piece that is to say all the parts constituting them are machined in the same part. These parts can be obtained by an additive manufacturing process and are preferably integrally formed. Also, the air injection ring and the injector connection bushing are formed in one piece, preferably obtained by an additive manufacturing process.

Preferably, the inlet 30 of the mixing device is located in the air passage of the second gimlet 262. Indeed, as can be seen in FIG. 2, the air arriving through the second gimlet 262 and guided by the venturi will directly arrive into the inlet 30 of the mixing device.

Thanks to the new arrangement of the elements of the injection system, it is observed that the fact of having the connection authorizing a displacement between the injector and the mixing device limits the area of recirculation at the venturi 32 and of leakage due to wear (particularly thanks to the swivel connection on the outer surface of the inlet of the mixing device and downstream of the venturi). Now, the leaks will spout into the gimlet.

Furthermore and advantageously, the injection nose 24 is arranged relative to the venturi 32 so as to open the fuel spray angle to the maximum without affecting the venturi 32 or the bowl 27 while maintaining a passage section between the nose 24 and the venturi 32. Indeed, when the whole is integrally formed, it is easier to position the different elements relative to each other since in this case there is no relative displacement between the parts. FIG. 3*a* illustrates the fuel spray S derived from the injection nose 24.

Furthermore, when the injector moves relative to the mixing device 25, the fact that the venturi and the air injection ring are formed with the injector then there are no obstructions at the air injection ring, the operation of the injection system is then not affected by these displacements.

FIGS. 3*b* and 3*c* illustrate two cases of displacement of the injector relative to the mixing device. It seen in these figures that the venturi 32 and the ring move but are not obstructed.

The dimensions of the different elements are fixed according to the margins of displacement to be authorized.

The injection system 22 described above is advantageously implemented in a combustion chamber 40 of a turbomachine as illustrated in FIG. 4.

The invention claimed is:

1. An air and fuel injection system of a turbomachine comprising:

an injector comprising a pipe and an injection nose housed inside the pipe, the pipe extending from upstream to downstream along a longitudinal axis;

a mixing device comprising a bowl, the bowl comprising an annular inlet, forming an inlet of the mixing device, from which a conical portion flared downstream extends, the mixing device being disposed downstream of the injection nose;

wherein the injector comprises an air injection ring extending from the pipe and from which a connection bushing comprising a divergent portion extends, the connection bushing being disposed externally around the annular inlet of the mixing device, wherein the inlet of the mixing device comprises an outer surface, the injector connection bushing being in contact with the inlet of the mixing device via the outer surface and the injector connection bushing being rotatably mounted in the mixing device.

2. The injection system according to claim 1, wherein the air injection ring is disposed downstream of the pipe.

3. The injection system according to claim 1, wherein the inlet of the mixing device is disposed downstream of the injection nose.

4. The injection system according to claim 1, wherein the outer surface takes the form of a truncated sphere, the injector connection bushing being in contact with the inlet of the mixing device via said truncated sphere.

5. The injection system according to claim 1, wherein the injector comprises a venturi located axially at the injection head.

6. The injection system according to claim 5, comprising a first gimlet disposed upstream of the venturi and a second gimlet disposed downstream of the venturi, said first and second gimlets comprising air passages.

7. The injection system according to claim 6, wherein the inlet of the mixing device is located in the air passage of the second gimlet.

8. The injection system according to claim 1, wherein the injection nose, the venturi, the air injection ring are formed in one piece, preferably obtained by an additive manufacturing process.

9. The injection system according to claim 1, wherein the air injection ring and the injector connection bushing are formed in one piece, preferably obtained by an additive manufacturing process.

10. A combustion chamber of a turbomachine comprising an injection system according to claim 1.

11. A turbomachine comprising a combustion chamber according to claim 10.

* * * * *